US005775397A

United States Patent [19]

Lippincott

[11] Patent Number: 5,775,397

[45] Date of Patent: Jul. 7, 1998

[54] LUMBER STAMPER

[75] Inventor: Thomas E. Lippincott, Wilmington, N.C.

[73] Assignee: Tank Fab, Inc., Rocky Point, N.C.

[21] Appl. No.: 887,145

[22] Filed: Jul. 2, 1997

[51] Int. Cl.[6] ..... B27M 1/00; B05D 3/12

[52] U.S. Cl. ..... 144/358; 29/432; 101/4; 101/35; 101/93.1; 144/4.8; 144/329; 144/380; 427/284

[58] Field of Search ..... 29/432; 427/284, 427/291; 101/4, 35, 57, 58, 93.1; 144/4.8, 2, 1, 329, 358, 364, 380, 356

[56] References Cited

U.S. PATENT DOCUMENTS

| | | | |
|---|---|---|---|
| 1,400,223 | 12/1921 | McDonough . | |
| 1,853,773 | 4/1932 | McDonough . | |
| 2,691,341 | 10/1954 | Williams . | |
| 4,169,173 | 9/1979 | Bergholm et al. . | |
| 4,324,519 | 4/1982 | Moore . | |
| 4,392,204 | 7/1983 | Prim . | |
| 5,392,829 | 2/1995 | McDonald et al. | 144/356 |

FOREIGN PATENT DOCUMENTS

| | | | |
|---|---|---|---|
| 2751186 | 5/1979 | Germany | 144/4.8 |
| 250427 | 8/1969 | U.S.S.R. | 144/4.8 |

*Primary Examiner*—W. Donald Bray
*Attorney, Agent, or Firm*—Rhodes, Coats & Bennett, L.L.P.

[57] ABSTRACT

The ends of a plurality of stacked lumber pieces are embossed with an apparatus that includes an embossing plate having a vertical, planar embossing surface with three-dimensional indicia thereon; a press plate spaced from the embossing plate, the press plate including a plurality of adjacent press plate segments, each having a lumber contact surface facing the embossing surface, each of the contact surfaces being movable between a retracted position and an extended position toward the embossing plate; a lumber support for supporting a plurality of stacked, parallel lumber pieces with first and second opposed ends between the plates with the first end of the lumber pieces being toward the embossing plate and the second end of the lumber pieces being toward the press plate; drive means attached to the press plate segments to independently move the plate segments between retracted and extended positions; and a controller operatively associated with the drive means to actuate the drive means in a predetermined sequence.

14 Claims, 3 Drawing Sheets

LUMBER STAMPER

BACKGROUND OF THE INVENTION (1). Field of the Invention

The present invention relates generally to a method and apparatus for placing indicia on the ends of a plurality of elongated articles, and in particular to a method and apparatus for impressing an identifying mark into the ends of stacked lumber pieces.

(2). Description of the Prior Art

Identification tags or markings are frequently applied to lumber pieces at the time of production to identify the manufacturer, and for various other reasons. While markings have historically been applied by stamping the lumber with an inked design, most lumber is currently identified by stapling or sticking a plastic tag to an end of each lumber piece. These tags may be applied by hand, or by use of an automated device, such as that shown in U.S. Pat. No. 5,208,962 to Walker, Jr.

Current techniques for identifying lumber have several deficiencies. Application of the tags by hand is slow, since the worker must manually attach a tag to the end of each lumber piece. Automated machinery, such as the Walker, Jr. device, while faster, requires the manual placement of each lumber piece onto a conveyor, so that the end of the piece will be conveyed past a stapler.

The tags often interfere with use of the lumber, or at least are unsightly, requiring their time consuming removal. In addition, removal of the tag defeats one of the primary purposes of their application in the first place; namely, the identification of the lumber manufacturer in the event of subsequently discovered defects in the lumber. If the lumber is stamped with an inked identifier instead of tagged, the ink also tends to fade over time.

A method and apparatus permitting the rapid application of permanent identifiers to the ends of lumber pieces without the need to subsequently remove the identifiers would be a considerable improvement over the prior art, and would result in reduced operating costs and greater convenience.

SUMMARY OF THE INVENTION

The present invention is directed to a method and apparatus for identifying lumber pieces. The invention relates especially to a method and apparatus for simultaneously impressing an identifier into the ends of a plurality of stacked lumber pieces.

The apparatus is generally comprised of a lumber support frame for supporting a stack of lumber, a lumber embossing plate having an embossing surface facing one end of the lumber support, a press plate at the opposite end of the lumber support, and drive means for clamping lumber supported on the support frame between the embossing plate and the press plate to impress the indicia on the embossing plate into the ends of the lumber abutting the embossing plate.

The embossing plate and press plate are normally carried on movable carriers that may be supported on tracks, so that the distance between each plate and the lumber support frame can be adjusted for lumber of different lengths. A frame may also be included in the apparatus to support the lumber support and the tracks for the carriers.

The embossing plate is generally vertical, and includes an embossing surface that is brought into contact with the ends of lumber pieces in the stack. The carrier supporting the embossing plate includes a frame, wheels to support the carrier on rails, and an adjustment means supported on the frame and attached to the plate, so that the horizontal position of the plate can be adjusted relative to the frame. The plate may also be joined to the frame by one or more adjustable attachments, so that the plate remains in a vertical position during adjustment and embossing. The embossing plate is moveable on a track that is parallel to the front of the lumber support, so that the position of the plate can be adjusted relative to the lumber support end.

The embossing surface is configured with a three-dimensional pattern or design, so that ends of lumber pressed against the embossing surface will have the design impressed therein. For example, the embossing surface can be configured with a repeating design or indicia, such as initials or a logo, having an area less than the area of an end of a lumber piece. Thus, when the lumber piece end is embossed, all of a design, or parts of two or more designs will be impressed into the lumber piece end.

The lumber support is designed to hold a stack of lumber, i.e., a plurality of elongated lumber pieces of approximately the same length that are stacked in a parallel, adjacent configuration. One stack of lumber may also be placed above another and separated by 2×4, or other, separating lumber pieces. The support may include a horizontal rest for horizontally supporting the lumber pieces. The lumber rest may be comprised of a plurality of spaced, parallel members that are positioned transversely to the lumber stack. The use of a plurality of members reduces the surface friction between the support and the lower surface of the lumber stack, facilitating sliding of the lumber. The lumber support may also include a vertical stop at the rear of the horizontal rest to prevent lumber from falling off of the rest.

In instances where the total end surface area of the lumber pieces being embossed is small, a single pressure plate may be used. However, in most instances use of a single plate will not be feasible due to the large force that would be required to simultaneously emboss all of the lumber pieces. For example, in embossing a stack of lumber pieces that together have an end surface area of 3.048 sq. in., a force of about 1,760,000 lbs. would be required to impress a permanent, visible indicia into the ends of all of the wood pieces. Also, lumber pieces tend to vary slightly in length, even when the intent is to cut the pieces to the same length. Therefore, when pressure is applied to a large number of pieces, the pressure will be largely against the longer pieces, leaving some of the shorter pieces unmarked.

In these instances, the present invention contemplates the use of a press plate comprised of a plurality of plate segments, each having a wood contact surface movable between a retracted position in a common plane with the surfaces of other plate segments that are in the retracted position, and an extended position in which the surface of the plate segment is in contact with one or more of the lumber pieces. The drive means is designed to move each plate segment independently, and in a predetermined sequence, to its extended position.

By using a press plate of this construction, clamping between the press plate and embossing plate is applied at any given time to only one or a few of the lumber pieces, instead of the entire stack, thereby permitting clamping to the desired pressure with a significantly lower clamping force, and minimizing variation in the marking on the lumber ends, due to small variations in the lengths of pieces being clamped.

The press plate is located on the opposite side of the lumber support frame from the embossing member, and is supported in a vertical attitude on a carrier that is supported by and movable on a track so that position of the press plate can be adjusted relative to the lumber support.

A drive means is provided to extend the pressure plate toward the lumber support. When using a multi-segment plate, the drive means includes a plurality of plate extenders, one connected to each plate, and a programmable controller for actuating the plate extenders in a predetermined sequence. The drive means may be formed of a source of a hydraulic cylinder connected to the rear of the plate, a source of pressured hydraulic fluid, and a controller to control the flow of fluid to the cylinder.

With a multi-segment plate, the drive means may use separate plate extenders for each plate segment, with the controller selectively controlling the actuation of each extender in a predetermined sequence. For example, a separate hydraulic cylinder may be attached to each plate segment with hydraulic fluid being directed from a single source through separate lines to each cylinder. The controller may be attached to solenoid valves in each line to control which line is open, and thus which cylinder is actuated to extend its attached plate.

A preferred embodiment of the invention contemplates an apparatus comprised of a base frame that includes a pair of spaced rails carried on the base frame parallel to the base frame longitudinal axis. The lumber support is comprised of a plurality of spaced, horizontal rests mounted centrally on the base frame transverse to the base frame longitudinal axis.

The embossing plate carrier is movably mounted on the rails at one end of the lumber support with the embossing plate being positioned vertically, and with its embossing surface facing the lumber support. The press plate carrier is movably mounted on the rails at the opposite end of the lumber support with the pressure plate being positioned vertically, and with its lumber contact surface facing the lumber support.

In the preferred embodiment, the forward end of a plate extender, e.g., a hydraulic cylinder, is connected to the center of the back of the embossing plate. The hydraulic cylinder is connected to a source of hydraulic fluid. Slidable supports are connected to each corner of the embossing plate to provide stability.

The pressure plate of the preferred embodiment is formed of a plurality of adjacent, extendible plate segments having lumber contacting surfaces in a common plane when in a retracted position. A plurality of hydraulic cylinders is used to move the plate segments between retracted and extended positions, with one hydraulic cylinder being connected at its forward end to the back of each segment. The cylinders are all connected with hydraulic lines via a controller to a source of hydraulic fluid.

The controller is programmed to sequentially direct the fluid to each segment in a predetermined sequence, to extend the segment toward the lumber support and engage lumber on the support that is in the path of the segment. Thus, all of the hydraulic pressure at a given time is directed to a segment of the plate instead of being spread of the entire plate surface, thereby greatly increasing the pressure exerted on the contacted lumber by the active segment.

Normally, each plate segment will be of a rectangular configuration, with a total area of from about 64 to about 512 sq. in., and the total plate will be formed of from about 6 to about 48 plate segments. Thus, it is possible to use a source of hydraulic fluid under a pressure of less than 3,000 p.s.i., to obtain a permanent impression in the end of the lumber pieces.

In operation of the preferred embodiment, the press plate is moved to the desired position so that the distance between the embossing and press plates is slightly greater than the length of the lumber to be embossed, and locked in position. A stack of lumber is positioned on the lumber support, with the individual lumber pieces being aligned with the longitudinal axis of the base frame. The carrier supporting the embossing plates is then moved inwardly along the rails until the embossing plate surfaces engage the ends of the lumber in the stack, and slides the lumber against the press plate.

Hydraulic pressure is then applied in a predetermined sequence to each of the plate segments. Each plate segment, upon actuation, is extended up to about 1 in. toward the lumber stack, engaging the few lumber pieces within the path of the segment, and pressing the opposite ends of the engaged pieces firmly against the embossing plate, thereby impressing the embossing plate indicia into the end of each lumber piece abutting the embossing plate. The actuated plate segment is then withdrawn and another segment is actuated to emboss the lumber in front of the next plate segment. After all lumber has been embossed, the stack of lumber is removed from the lumber support.

Accordingly, one aspect of the present invention is to provide an apparatus for embossing the ends of a plurality of elongated articles, such as lumber pieces comprising an embossing plate having an embossing surface with three-dimensional indicia thereon; a press plate spaced from the embossing plate, the press plate having a lumber contact surface facing the embossing surface; a lumber support for supporting a plurality of stacked, parallel lumber pieces with first and second opposed ends between the plates with the first end of the lumber pieces being toward the embossing plate and the second end of the lumber pieces being toward the press plate; and drive means attached to one of the plates to move the plate toward the other of the plates to press the first ends of the lumber against the embossing surface, whereby the first ends of the lumber are embossed with the indicia.

It is another aspect of the invention to provide an apparatus for embossing the ends of a plurality of lumber pieces comprising an embossing plate having a vertical embossing surface with three-dimensional indicia thereon; a press plate spaced from the embossing plate, the press plate including a plurality of adjacent press plate segments, each having a lumber contact surface facing the embossing surface, each of the contact surfaces being movable between a retracted position and an extended position toward the embossing plate; a lumber support for supporting a plurality of stacked, parallel lumber pieces with first and second opposed ends between the plates with the first end of the lumber pieces being toward the embossing plate and the second end of the lumber pieces being toward the press plate; drive means attached to the press plate segments to independently move the plate segments between retracted and extended positions; and a controller operatively associated with the drive means to actuate the drive means in a predetermined sequence.

It is yet another aspect of the invention to provide a method for embossing the ends of a plurality of articles, such as lumber pieces comprising the steps of providing an embossing plate having a vertical embossing surface with three-dimensional indicia thereon; supporting a plurality of stacked, parallel lumber pieces with first ends of the lumber pieces toward the embossing plate and opposed second ends away from the plate; and pressing the first ends of the lumber pieces against the embossing plate to impress the indicia into the first ends. In the method only a portion of the first ends may be pressed against the embossing plate at a given time.

These and other aspects of the present invention will become apparent to those skilled in the art after a reading of the following description of the preferred embodiment.

DETAILED DESCRIPTION OF THE INVENTION

Figure 1:
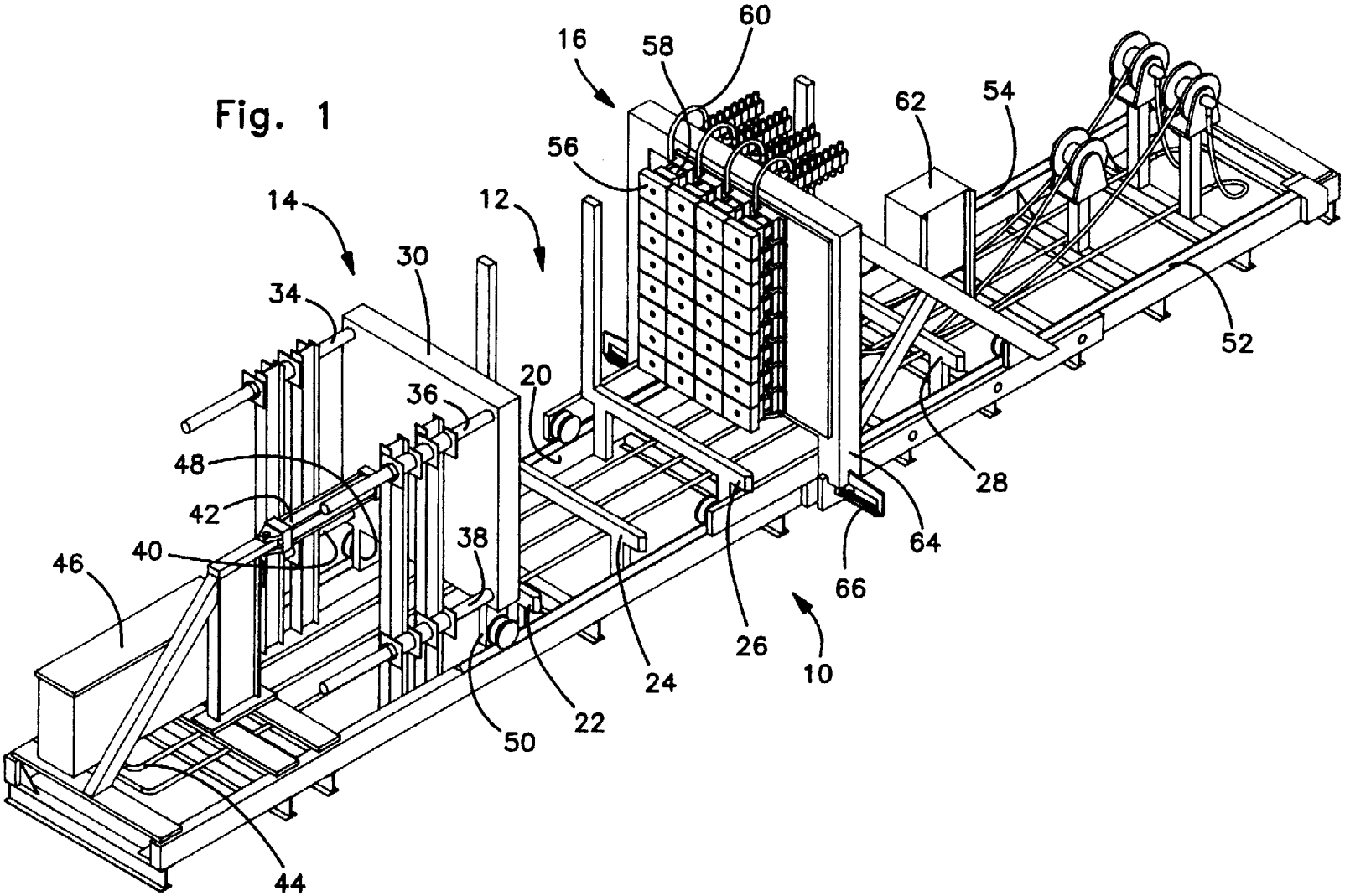
FIG. 1 is a perspective view of the apparatus viewed from the embossing plate end.
Figure 2:
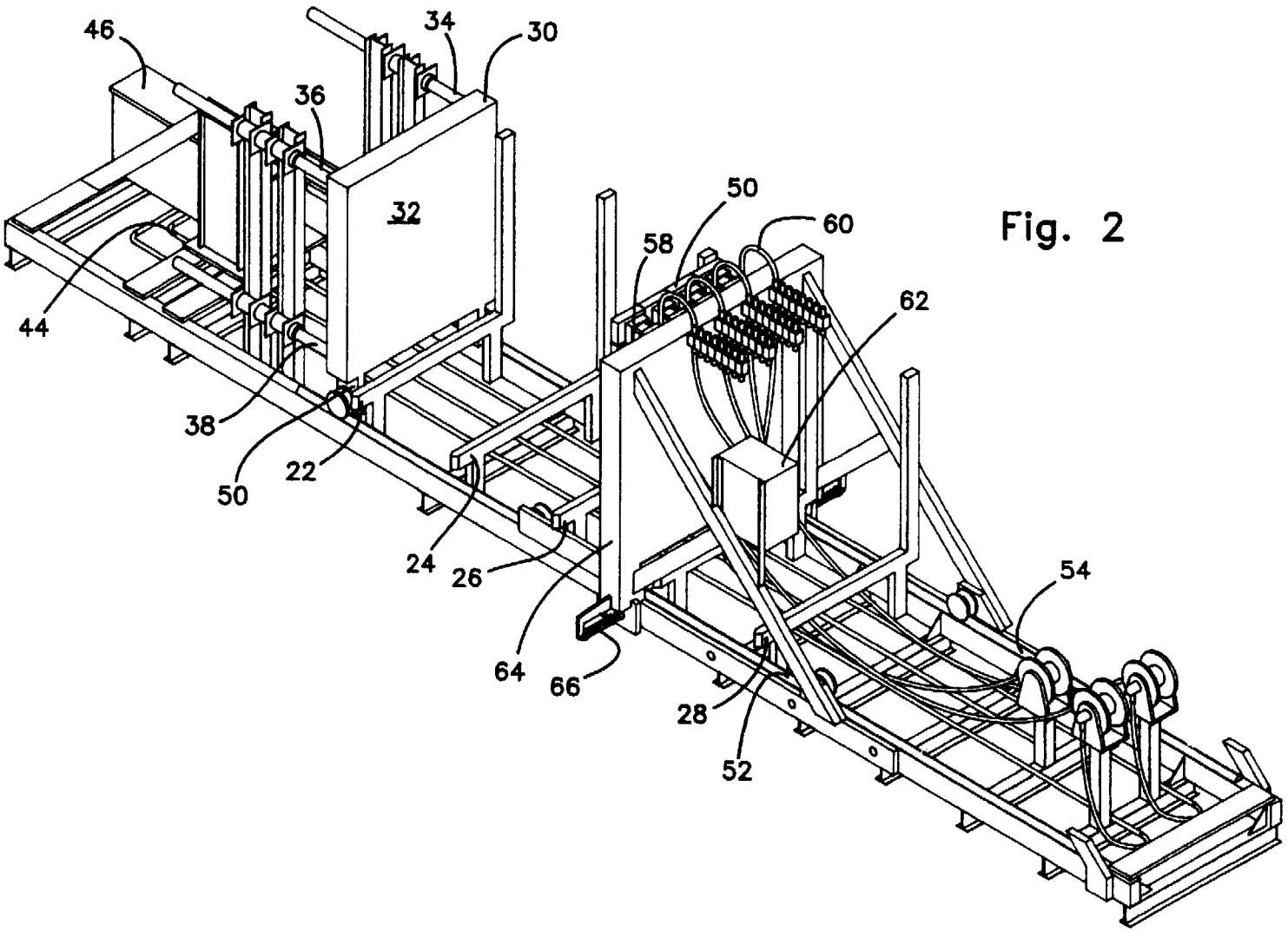
FIG. 2 is a perspective view of the apparatus viewed for the pressure plate end.
Figure 3:
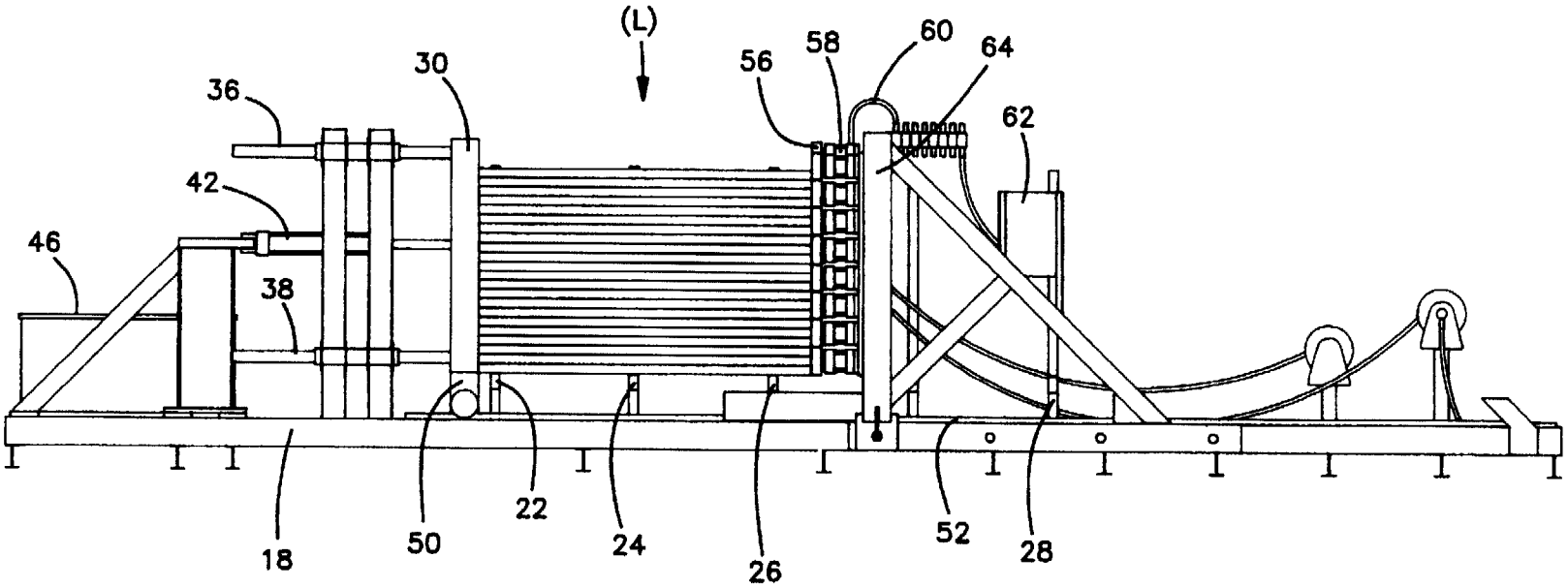
FIG. 3 is a side view of the apparatus viewed from the front.

In the following description, terms such as horizontal, upright, vertical, above, below, beneath, and the like, are used solely for the purpose of clarity in illustrating the invention, and should not be taken as words of limitation.

The apparatus illustrated in the drawings is comprised of a base frame, generally 10; a lumber support, generally 12, mounted transversely on the central part of frame 10; an embossing member, generally 14, mounted on one end on frame 10; and a press member, generally 16, mounted at the opposite end of frame 10.

Base frame 10 includes parallel longitudinal members 18 and 20. Lumber support 12 is comprised of identical parallel arms 22, 24, 26 and 28, each having a horizontal lumber rest and a vertical stop, mounted transversely on members 18 and 20.

Embossing member 14 is comprised of a vertical embossing plate 30 having an embossing face or surface 32 toward lumber support 12. Plate 30 is slidably supported by slidable supports 34, 36, 38 and 40 attached to upright sections of frame 14. A hydraulic cylinder 42 is secured to the center of the back of plate 30, and is connected by hydraulic line 44 to a hydraulic fluid supply 46. Plate 30 is also supported by wheeled legs 48 and 50 that ride on parallel rails 52 and 54 on the upper surface of frame 10.

Press member 16 is comprised of a plurality of adjacent identical plate segments 56 Hydraulic cylinders 58 used to move plate segments 56 between retracted and extended positions, are attached to the back of each segment 56. Cylinders 58 are connected with hydraulic lines 60 via controller 62 to hydraulic fluid supply 44. Some of lines 60 have been omitted for clarity. Plate segments 56 are supported in a common plane on a wheeled press frame 64, that rides on rails 52 and 54. Press frame 64 may be positioned at a distance of from 6 to 24 from embossing plate 30 to accommodate different lengths of lumber, and is locked at the desired position with lock 66.

In operation, press member 16 is moved along rails 52 and 54 until the distance between press plate segments 56 and embossing plate 30 is slightly greater that the length of the lumber to be embossed. A stack of lumber (L) is positioned on the lumber support 12, with the individual lumber pieces being aligned with the longitudinal axis of the base frame 10. Embossing plate 30 is moved toward the lumber stack with hydraulic cylinder 42 until surface 32 of plate 30 abuts one end of the lumber stack, and pushes the opposite end of the lumber stack against plate segments 56.

Hydraulic pressure is then applied in a predetermined sequence to each of the plate segments 56. As each plate segment 56 is actuated, it is extended toward the lumber stack by up to about 1 inch to engage the few lumber pieces within its path, pressing the engaged lumber pieces firmly against surface 32 of embossing plate 30, impressing the embossing plate indicia into the ends of the lumber pieces. This procedure is repeated with the other plate segments until all of the lumber pieces have been embossed.

Certain modifications and improvements will occur to those skilled in the art upon a reading of the foregoing description. By way of example, instead of using a multi-segment press plate, it is possible to use a multi-segment embossing plate. Also, instead of using hydraulic cylinders, other means, such as mechanical linkages or air cylinders, may be employed to move the embossing plate or the press plate segments toward the lumber pieces. It should be understood that all such modifications and improvements have been deleted herein for the sake of conciseness and readability but are properly within the scope of the follow claims.

What is claimed is:

1. An apparatus for embossing the ends of a plurality of elongated articles comprising:

a) a embossing plate having an embossing surface with threedimensional indicia thereon;

b) a press plate spaced from said embossing plate, said press plate having an article contact surface facing said embossing surface;

c) a support for supporting a plurality of elongated articles with first and second opposed ends between said plates with the first ends of said articles being toward said embossing plate and the second ends of said articles being toward said press plate; and d) drive means attached to one of said plates to move said plate toward the other of said plates to press said first ends of said articles against said embossing surface, whereby the first ends of said articles are embossed with said indicia.

2. The apparatus of claim 1, wherein said article support is comprised of a plurality of spaced, parallel support arms, each arm having a horizontal article supporting member.

3. The apparatus of claim 2, wherein each support arm further includes a vertical stop member extending upwardly from said horizontal member.

4. The apparatus of claim 1, further including an embossing plate carrier supporting said embossing plate and adapted to move said plate toward said article support.

5. The apparatus of claim 1, wherein one of said plates is comprised of a plurality of plate segments having article contacting surfaces toward said article support, each plate segment being movable between a retracted position and an extended position.

6. The apparatus of claim 5, wherein said plate is the press plate.

7. The apparatus of claim 5, further including a plurality of hydraulic cylinders, each plate segment being connected to a hydraulic cylinder.

8. An apparatus for embossing the ends of a plurality of lumber pieces comprising:

a) an embossing plate having a vertical embossing surface with three-dimensional indicia thereon;

b) a press plate spaced from said embossing plate, said press plate including a plurality of adjacent press plate segments, each having a lumber contact surface facing said embossing surface, each of said contact surfaces being movable between a retracted position and an extended position toward said embossing plate;

c) a lumber support for supporting a plurality of stacked, parallel lumber pieces with first and second opposed ends between said plates with the first end of said lumber pieces being toward said embossing plate and the second end of said lumber pieces being toward said press plate;

d) drive means attached to said press plate segments to independently move said plate segments between retracted and extended positions; and e) a controller operatively associated with said drive means to actuate said drive means in a predetermined sequence.

9. The apparatus of claim 8, further including an adjustment means for horizontally adjusting said embossing plate relative to said lumber support.

10. The apparatus of claim 8, further including a press plate carrier to position said press plate relative to said lumber support.

11. The apparatus of claim 8, wherein said drive means are a plurality of hydraulic cylinders.

12. A method for embossing the ends of a plurality of elongated articles comprising:

a) providing an embossing plate having a vertical embossing surface with three-dimensional indicia thereon;

b) supporting a plurality of elongated articles having first ends toward said embossing plate and opposed second ends away from said plate; and c) pressing the first ends of said articles against said embossing plate to impress said indicia into said first ends.

13. The method of claim 12, wherein only a portion of said first ends are pressed against said embossing plate at a given time.

14. The method of claim 12, wherein said elongated pieces are lumber pieces.

* * * * *